US010921050B1

(12) United States Patent
El-Sayed et al.

(10) Patent No.: US 10,921,050 B1
(45) Date of Patent: Feb. 16, 2021

(54) SUPPORT ASSEMBLY FOR APPLIANCE

(71) Applicant: WHIRLPOOL CORPORATION, Benton Harbor, MI (US)

(72) Inventors: Kamil El-Sayed, Wroclaw (PL); Abhay Naik, Stevensville, MI (US); Chad Rotter, Saugatuck, MI (US); Bartosz Stawczyk, Wroclaw (PL); Karol Michal Kostka, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/597,889

(22) Filed: Oct. 10, 2019

(51) Int. Cl.

| | |
|---|---|
| ***F25D 23/06*** | (2006.01) |
| ***F25D 25/02*** | (2006.01) |
| ***A47B 57/40*** | (2006.01) |
| ***A47B 57/42*** | (2006.01) |

(52) U.S. Cl.
CPC ..... *F25D 23/067* (2013.01); *A47B 57/408* (2013.01); *A47B 57/42* (2013.01); *F25D 25/024* (2013.01); *F25D 25/025* (2013.01)

(58) Field of Classification Search
CPC ..... F25D 23/067; F25D 25/02; F25D 25/024; F25D 25/025; F25D 2325/00; A47B 57/08; A47B 57/10; A47B 57/32; A47B 57/34; A47B 57/40; A47B 57/402; A47B 57/408; A47B 57/42
See application file for complete search history.

(56) References Cited

U.S. PATENT DOCUMENTS

| | | | | |
|---|---|---|---|---|
| 1,828,435 | A * | 10/1931 | Otte | F25D 25/02 312/408 |
| 1,997,793 | A * | 4/1935 | Hull | F25D 25/02 312/408 |
| 2,576,865 | A | 10/1948 | Vanderveld | |
| 3,325,129 | A * | 6/1967 | Tinfow | A47B 57/42 248/243 |
| 3,888,440 | A | 6/1975 | Rebentisch | |
| 4,048,768 | A | 9/1977 | Good | |
| 4,198,913 | A * | 4/1980 | Haworth | A47B 96/061 108/108 |
| 4,222,542 | A * | 9/1980 | Wilson | A47B 57/42 211/192 |

(Continued)

FOREIGN PATENT DOCUMENTS

CH 674881 A5 * 7/1990 ..... A47B 57/34

*Primary Examiner* — Andrew M Roersma
(74) *Attorney, Agent, or Firm* — Price Heneveld LLP

(57) ABSTRACT

A vacuum insulated appliance includes an outer wrapper and an inner liner. A ladder rack is coupled to the inner liner. The ladder rack includes first and second sidewalls coupled together by a connecting wall that defines a plurality of apertures. An adapter member includes a hook configured to extend through an aperture of the plurality of apertures when coupled to the ladder rack. The adapter member is coupled with a locking member that engages inner surface of first and second sidewalls of the ladder rack. A cantilever support is coupled to the adapter member and extends outward from the ladder rack. A rail assembly is coupled to an upper surface of the cantilever support. A spacer is coupled to an end of the cantilever support and abuts an inner liner surface. A storage feature is coupled to the rail assembly and is operable between stowed and deployed positions.

19 Claims, 6 Drawing Sheets

(56) References Cited

U.S. PATENT DOCUMENTS

| | | | | |
|---|---|---|---|---|
| 4,324,379 | A | 4/1982 | Ovitz, III | |
| 4,365,562 | A | 12/1982 | Webb | |
| 5,022,621 | A * | 6/1991 | Quest | A47B 57/408 248/222.13 |
| 5,538,213 | A * | 7/1996 | Brown | A47B 57/42 108/108 |
| 5,735,589 | A * | 4/1998 | Herrmann | B29C 33/123 108/102 |
| 8,419,143 | B2 | 4/2013 | Shin et al. | |
| 8,881,660 | B2 | 11/2014 | Simpson et al. | |
| 8,944,621 | B2 * | 2/2015 | Driver | A47B 57/42 362/92 |
| 9,131,771 | B2 * | 9/2015 | Lindblom | A47B 96/028 |
| 2009/0084914 | A1 * | 4/2009 | Picken | F25D 25/024 248/206.5 |
| 2017/0159995 | A1 * | 6/2017 | Allo | B29C 43/00 |
| 2018/0128538 | A1 * | 5/2018 | Jang | F25D 25/024 |

* cited by examiner

SUPPORT ASSEMBLY FOR APPLIANCE

BACKGROUND OF THE DISCLOSURE

The present disclosure generally relates to a support assembly, and more specifically, to a support assembly for an appliance.

SUMMARY OF THE DISCLOSURE

According to one aspect of the present disclosure, a vacuum insulated appliance includes an outer wrapper and an inner liner positioned within the outer wrapper. A ladder rack is coupled to the inner liner. The ladder rack includes first and second sidewalls coupled together via a connecting wall that defines a plurality of apertures. An adapter member includes a hook configured to extend through an aperture of the plurality of apertures when coupled to the ladder rack. The adapter member is coupled with a locking member that engages inner surfaces of the first and second sidewalls of the ladder rack. A cantilever support is coupled to the adapter member and extends outward from the ladder rack. A rail assembly is coupled to an upper surface of the cantilever support. A spacer is coupled to an end of the cantilever support and abuts an inner liner surface. A storage feature is coupled to the rail assembly and operable between stowed and deployed positions.

According to another aspect of the present disclosure, an appliance support assembly includes an inner liner and a ladder rack coupled to the inner liner. The ladder rack includes first and second sidewalls. A cantilever support is coupled to the ladder rack and extends outwardly therefrom. A rail assembly is disposed on an upper surface of the cantilever support. A spacer is coupled to an outer surface of the cantilever support and abuts an inner liner surface. A locking member is coupled to the cantilever support and engages the first and second sidewalls of the ladder rack. A storage feature is coupled to the rail assembly and is operable between stowed and deployed positions.

According to yet another aspect of the present disclosure, a support assembly for an insulated appliance includes first and second ladder racks coupled to an inner liner of said insulated structure and are spaced-apart from one another. First and second adapter members are coupled to the first and second ladder rack. First and second cantilever supports are coupled to the first and second ladder racks via the first and second adapter members. A locking member engages one of the first and second ladder racks and one of the first and second adapter members. First and second rail assemblies are disposed on the first and second cantilever supports. A storage feature is coupled to the first and second rail assemblies and is operable between stowed and deployed positions.

These and other features, advantages, and objects of the present disclosure will be further understood and appreciated by those skilled in the art by reference to the following specification, claims, and appended drawings.

Figure 1:
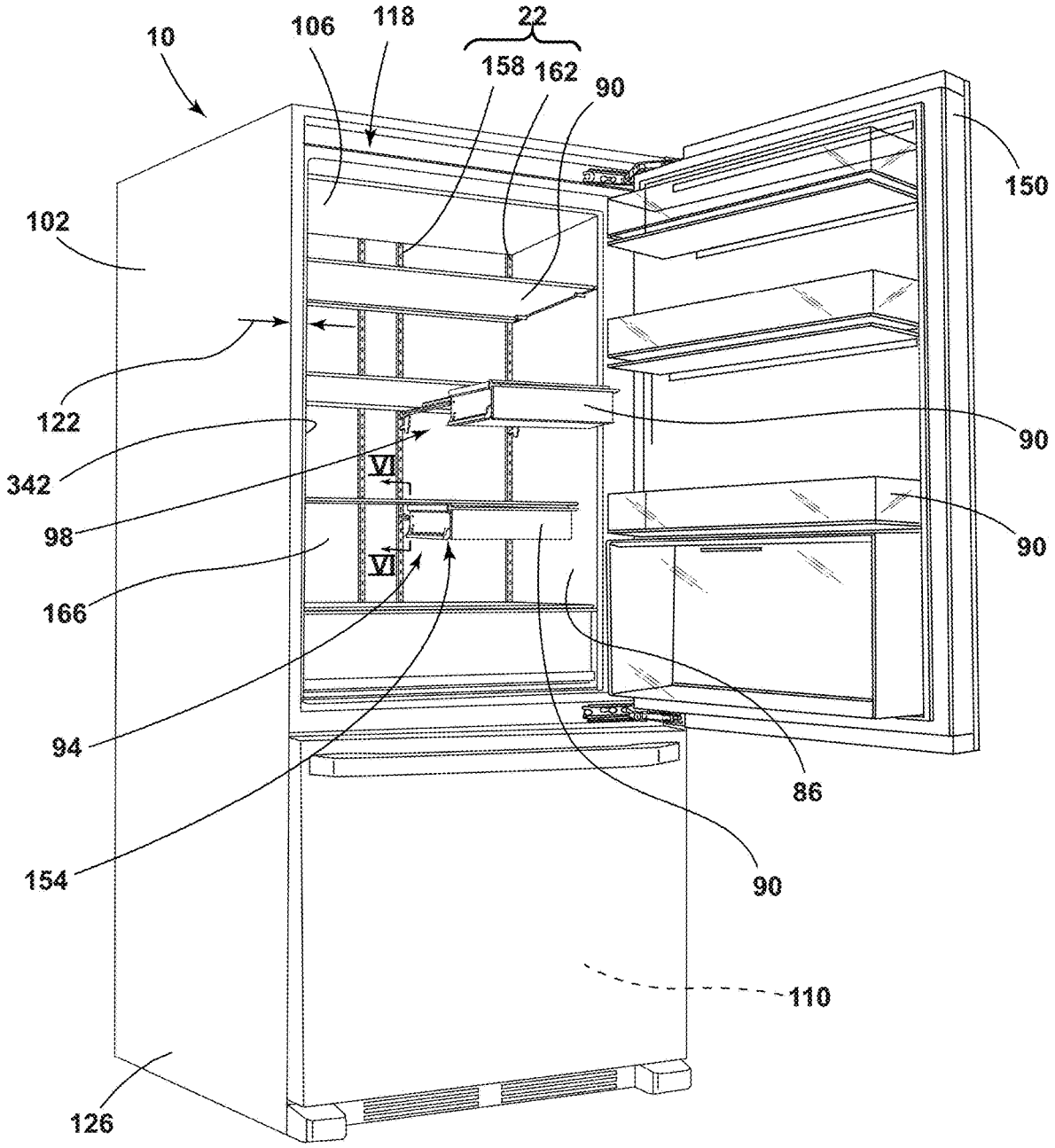
FIG. 1 is a front perspective view of an appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a support assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally designates an appliance that includes an outer wrapper 14 and an inner liner 18 positioned within the outer wrapper 14. A ladder rack 22 is coupled to the inner liner 18. The ladder rack 22 includes first and second sidewalls 26, 30 coupled together via a connecting wall 34 that defines a plurality of apertures 38. An adapter member 42 includes a hook 46 configured to extend through an aperture 50 of the plurality of apertures 38 when coupled to the ladder rack 22. The adapter member 42 is coupled with a locking member 54 that engages inner surfaces 58, 62 of the first and second sidewalls 26, 30 of the ladder rack 22. A cantilever support 66 is coupled to the adapter member 42 and extends outward from the ladder rack 22. A rail assembly 70 is coupled to an upper surface 74 of the cantilever support 66. A spacer 78 is coupled to a first end 82 and abuts an inner liner surface 86. A storage feature 90 is coupled to the rail assembly 70 and is operable between stowed and deployed positions, 94, 98.

Figure 2:
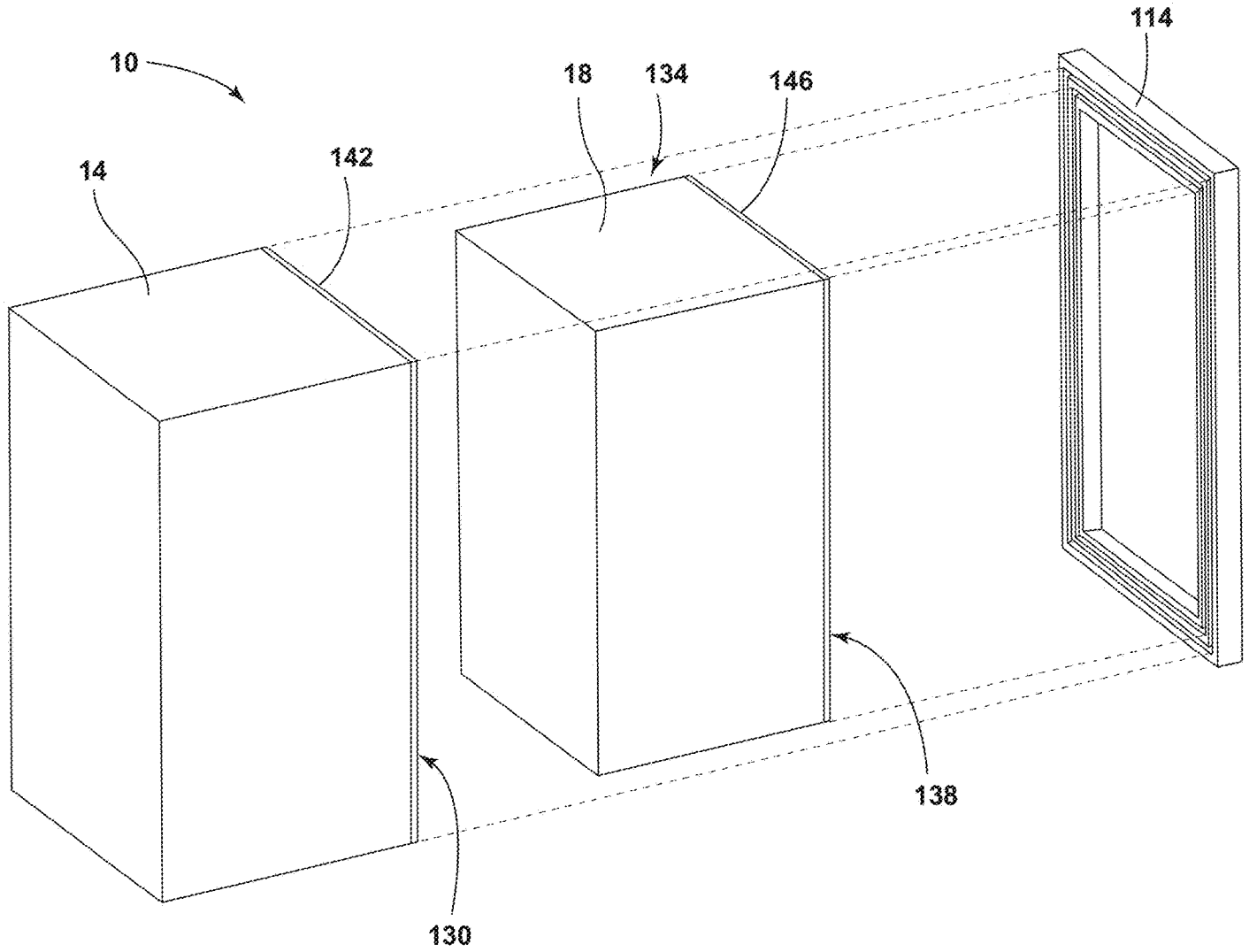
FIG. 2 is an exploded top perspective view of an insulating appliance, according to the present disclosure.

Referring to FIGS. 1 and 2, the appliance 10 is illustrated as a refrigerator that includes a cabinet 102 that defines refrigerator and freezer compartments 106, 110. While illustrated as a bottom-mount refrigerator, the appliance 10 may be, for example, a bottom-mount French door refrigerator, a top-mount refrigerator, a side-by-side refrigerator, a four-door French door refrigerator, and/or a five-door French door refrigerator. Further, the present disclosure is not limited to refrigerators. The appliance 10 may be, for example, freezers, coolers, vacuum insulated structures, storage structures, and other similar appliances and fixtures within household and commercial settings.

The appliance 10, as illustrated in FIGS. 1 and 2, is an insulating appliance 10, which includes a trim breaker 114, the outer wrapper 14, and the inner liner 18. The outer wrapper 14 and the inner liner 18 may be coupled to the trim breaker 114 to define an insulating cavity 118, in which one or more insulation materials may be disposed. The insulation materials may be a carbon-based powder and/or silicone oxide-based materials, however, it is generally contemplated that other insulation materials may be used. Additionally, the insulation materials can be free-flowing materials that can be poured, blown, compacted, or otherwise disposed within the insulating cavity 118. This free-flowing material can be in the form of various silica-based materials, such as fumed silica, precipitated silica, nano-sized, and/or micro-sized aerogel, powder, rice husk ash, powder, perlite, glass spheres, hollow glass spheres, cenospheres, diatomaceous earth, combinations thereof, and/or other similar insulating particulate materials.

In various examples, the one or more insulation materials may substantially fill the insulating cavity 118 to form a substantially continuous layer between the outer wrapper 14 and the inner liner 18. A vacuum 122, or at least a partial vacuum 122, may be defined within the insulating cavity 118 and may define a pressure differential between an exterior 126 of the appliance 10 and the insulating cavity 118. This pressure differential may serve to define an inward compressive force that may be exerted upon one and/or both of the outer wrapper 14 and the inner liner 18. This pressure differential also tends to bias the outer wrapper 14 and the inner liner 18 toward the insulating cavity 118 of the appliance 10. The vacuum 122 within the insulating cavity 118 also tends to cause gas to infiltrate the insulating cavity 118 from an area exterior to the appliance 10. This infiltration of gas is sometimes referred to as gas permeation.

The outer wrapper 14 and the inner liner 18 may be configured to form the cabinet 102 of the appliance 10. In this way, the outer wrapper 14 may have a three-dimensional shape and may define a central cavity 130. The inner liner 18 may correspond with the outer wrapper 14 and may have a plurality of panels 134. Each of the plurality of panels 134 includes the inner liner surface 86. Additionally or alternatively, the plurality of panels 134 of the inner liner 18 may form an inner cavity 138. It is generally contemplated that the inner liner 18 may be received within the central cavity 130 of the outer wrapper 14, and thus partially defines the insulating cavity 118. Stated differently, the inner liner 18 may be positioned within the outer wrapper 14 and may define the insulating cavity 118 therebetween. According to various aspects, the outer wrapper 14 and the inner liner 18 may include materials that are capable of at least partially resisting, bending, biasing, or otherwise being formed in response to the inward compressive force. These materials may include, but are not limited to, metals, plastics, polymers, metal alloys, combinations thereof, and/or other similar substantially rigid materials that can be used for vacuum insulated structures within appliances 10.

It is contemplated that the trim breaker 114 may be coupled to outer edges 142, 146 of the outer wrapper 14 and the inner liner 18. As illustrated in FIG. 2, the trim breaker 114 has a generally rectangular shape, however, it is contemplated that other geometric shapes known in the art may be used. In this way, the trim breaker 114 may not substantially interfere with access to the refrigerator and freezer compartments 106, 110 defined by the cabinet 102. In various examples, the trim breaker 114 may operate to seal the insulating cavity 118 between outer wrapper 14 and inner liner 18.

Referring again to FIG. 1, the appliance 10 may include a plurality of storage features 90 disposed within the refrigerator and/or freezer compartments 106, 110. As illustrated in FIG. 1, the storage feature 90 may have a variety of configurations. In this way, the storage feature 90 may be a shelf, a bin, a drawer, and/or a wine rack. The appliance 10 may include more than one storage feature 90 that each have different configurations. For example, as illustrated in FIG. 1, the appliance 10 includes multiple storage features 90 within the refrigerator compartment 106 that are configured as shelves or drawers and multiple storage features 90 that are configured as bins disposed on a door 150 of the appliance 10. According to various aspects, one or more of the storage features 90 of the appliance 10 may be coupled to the appliance 10 by a first support assembly 154. The first support assembly 154 can be included in the vacuum insulated appliance 10. Additionally or alternatively, the first support assembly 154 can be included in any practicable structure including plastic and/or metal inner liners 18.

According to various aspects, the first support assembly 154 may include first and second ladder racks 158, 162 coupled to the inner liner 18. As illustrated in FIG. 1, the first and second ladder racks 158, 162 are coupled to a rear panel 166 of the inner liner 18 and are spaced-apart from one another in a parallel configuration. The first and second ladder racks 158, 162 may extend vertically within the cabinet 102, or alternatively, may extend horizontally within the cabinet 102. More or fewer ladder racks 22 may be included in the appliance 10 with the storage feature 90 based on the configuration of the appliance 10.

Figure 3:
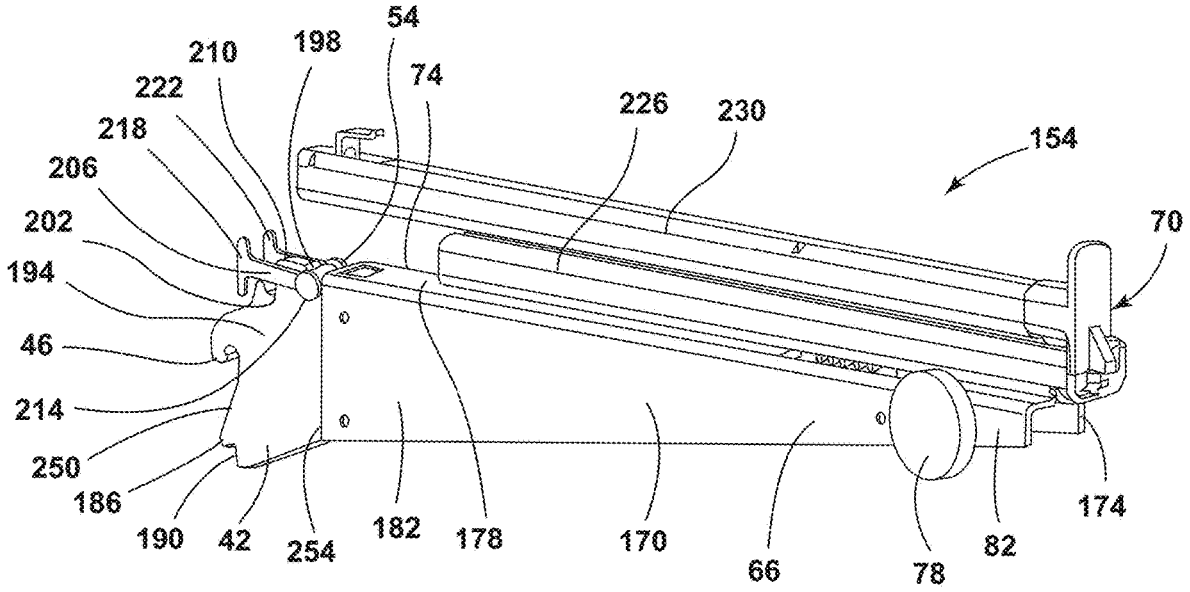
FIG. 3 is a side perspective view of a support assembly for a storage feature for an appliance, according to the present disclosure.

Referring to FIG. 3, the first support assembly 154 may include the cantilever support 66 coupled to the adapter member 42. The cantilever support 66 may include a first side 170, a second side 174, and an upper support wall 178 that extends therebetween. In various examples, the cantilever support 66 may include a hollow interior defined between the first and second sides 170, 174 and the upper support wall 178. The hollow interior may be advantageous to reduce manufacturing and production costs, as well as to reduce a weight of the first support assembly 154. Additionally or alternatively, the cantilever support 66 may taper from a second end 182 proximate the adapter member 42 to the first end 82. In this way, the second end 182 may have a height greater than a height of the first end 82 of the cantilever support 66.

Figure 4:
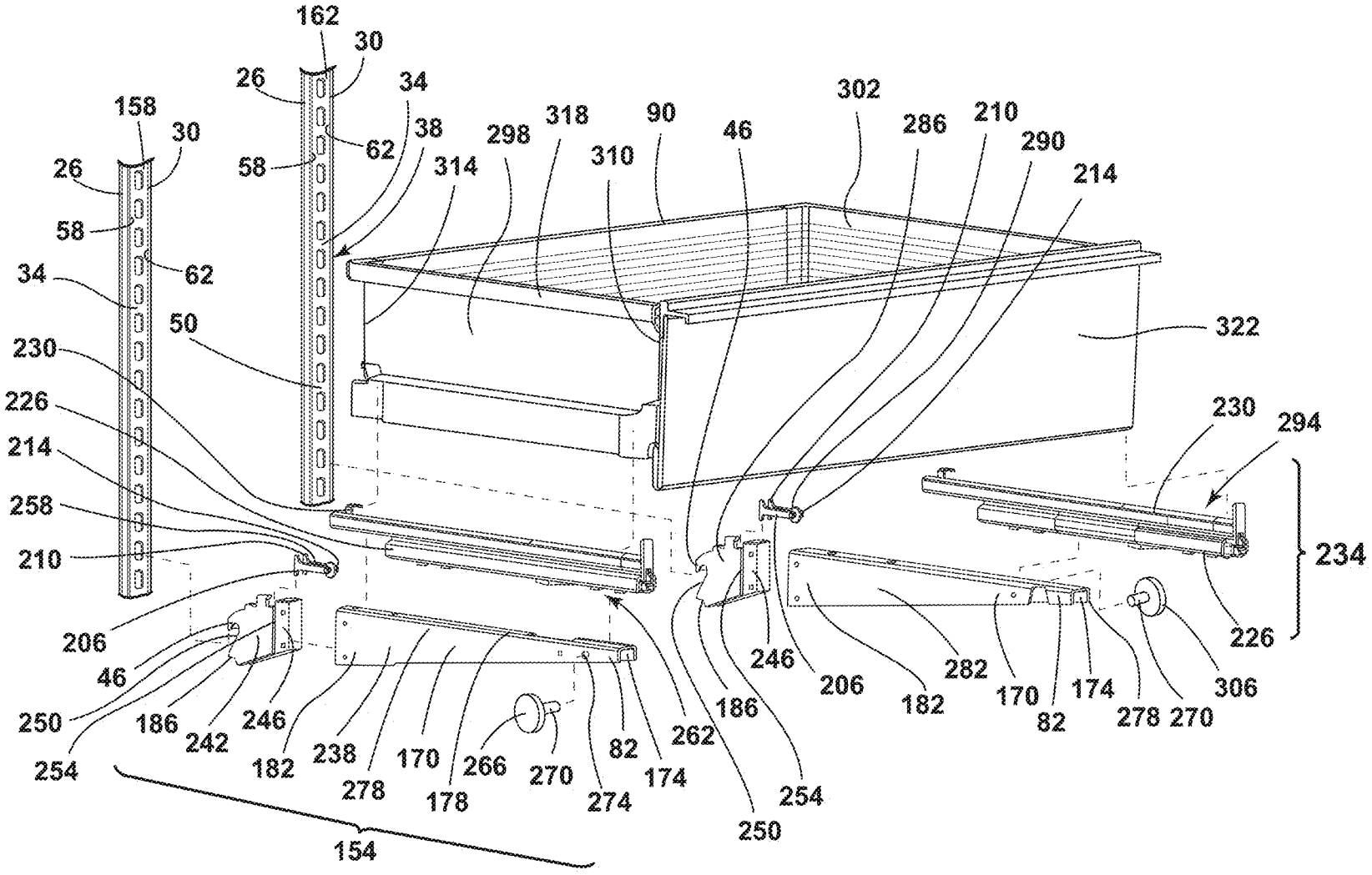
FIG. 4 is an exploded side perspective view of first and second support assemblies for a storage feature for an appliance, according to the present disclosure.

According to various aspects, the cantilever support 66 may be mechanically fastened to the adapter member 42. In this way, the cantilever support 66 and the adapter member 42 may be coupled together via a mechanical fastener, such as, for example, a screw, a bolt rivet, or other similar fasteners. The cantilever support 66 may include materials that can work and support the storage features 90 (FIG. 1). These materials may include, for example, metal and metal alloys. According to various aspects, the adapter member 42 may be coupled to the second end 182 of the cantilever support 66. Similar to the cantilever support 66, the adapter member 42 may include metal materials and/or metal alloy materials. In various examples, the adapter member 42 may include the hook 46 that extends outward and downward relative to the cantilever support 66. The hook 46 may be configured to couple the adapter member 42, and accordingly, the first support assembly 154 to one of the first and second ladder racks 158, 162 (FIG. 1). Additionally or alternatively, the adapter member 42 may define a projection 186 that extends outward from the adapter member 42 away from the cantilever support 66. The projection 186 may be configured to assist in coupling the adapter member 42 to one of the first and second ladder racks 158, 162. The adapter member 42 may further include an abutting surface 190 disposed proximate the projection 186 and configured to abut one of the first and second ladder racks 158, 162. In various examples, the abutting surface 190 may abut the connecting wall 34 (FIG. 4).

In various examples, an upper portion 194 of the adapter member 42 may be configured to receive the locking member 54. The adapter member 42 may define a notch 198 proximate the second end 182 of the cantilever support 66. Additionally or alternatively, the adapter member 42 may define a cutout 202 spaced-apart from the notch 198. The cutout 202 may be advantageous for preventing and/or minimizing interference between the locking member 54 and the adapter member 42 when assembled to the ladder rack 22 (FIG. 1).

Referring still to FIG. 3, the locking member 54 may be coupled to the adapter member 42. According to various aspects, the locking member 54 may include first and second arms 206, 210 that are coupled together via a connector 214. The first and second arms 206, 210 may extend, in a same direction, away from the connector 214. Stated differently, the first and second arms 206, 210 extend from the connector 214, in the same direction, away from the cantilever support 66. When assembled with the adapter member 42 and the cantilever support 66, the connector 214 may be disposed proximate the second end 182 of the cantilever support 66 and the first and second arms 206, 210 may extend outwardly therefrom. The first and second arms 206, 210 may be substantially horizontally aligned with the upper support wall 178 of the cantilever support 66. Additionally or alternatively, the first and second arms 206, 210 may include distal engagement portions 218, 222. The distal engagement portions 218, 222 may be at an opposing end of the locking member 54 relative to the connector 214. The distal engagement portions 218, 222 may extend substantially vertically, such that the distal engagement portions 218, 222 may be substantially perpendicular to the first and second arms 206, 210. As such, the first and second arms 206, 210 may have substantially T-shaped configurations. In various examples, the locking member 54 may include plastic materials, such as, for example, polypropylene and polyoxymethylene.

Referring still to FIG. 3, the first support assembly 154 may include the spacer 78 coupled to the first end 82 of the cantilever support 66. The spacer 78 may be coupled to at least one of the first and second sides 170, 174 of the cantilever support 66. According to various aspects, the spacer 78 may include plastic materials and/or rubber materials. In plastic examples, the spacer 78 may have an increased rigidity, such that there is minimal and/or no elastic deformation of the spacers 78. In rubber examples, the spacer 78 may elastically deform in response to a force acting upon the spacer 78.

The rail assembly 70 may be disposed on the upper surface 74 of the upper support wall 178 of the cantilever support 66. The rail assembly 70 may include a rail 226 fixedly coupled to the upper support wall 178 of the cantilever support 66. A rail slide 230 may slidably engage the rail 226. The rail slide 230 may be coupled to the rail 226 and be configured to slide fore and aft relative to the rail 226. In this way, when the rail slide 230 moves fore and aft relative to the rail 226, the rail slide 230 may define the stowed and deployed positions 94, 98.

Referring now to FIG. 4, the storage features 90 may be supported by the first support assembly 154 and a second support assembly 234. The first support assembly 154 may include a first cantilever support 238 coupled to a first adapter member 242. The first adapter member 242 may include a coupling portion 246 configured to be inserted within the interior of the first cantilever support 238, defined by the first and second sides 170, 174 and the upper support wall 178. The first adapter member 242 may be mechanically fastened to the first cantilever support 238. A rear edge 250 of the first adapter member 242 may have a height greater than a height of a front edge 254 of the adapter member 242. The front edge 254 may have a substantially similar height as the second end 182 of the first cantilever support 238. In this way, the front edge of the first adapter member 242 (e.g., the coupling portion 246) may substantially align with the second end 182 of the first cantilever support 238. The height of the first adapter member 242 may increase from the front edge 254 to the rear edge 250. This configuration may be advantageous for increasing the surface area of the first adapter member 242 that engages with the first ladder rack 158.

The first support assembly 154 may include a first locking member 258, which includes the first and second arms 206, 210 and the connector 214. The connector 214 of the first locking member 258 may be disposed within the notch 198 defined by the first adapter member 242. A first rail assembly 262 may be disposed on the upper support wall 178 of the first cantilever support 238. The first rail assembly 262 may include the rail 226 fixedly coupled to the first cantilever support 238 and the rail slide 230 slidably engaged with the rail 226. Additionally or alternatively, the first support assembly 154 may include a first spacer 266. The first spacer 266 may include a protrusion 270 that extends therefrom. The protrusion 270 may engage a receiving aperture 274 defined by the first cantilever support 238. As illustrated in FIG. 4, the receiving aperture 274 is defined by the first side 170 of the first cantilever support 238. In this way, the first spacer 266 may be coupled to an outer surface 278 of the first cantilever support 238.

In various examples, the storage features 90 may also be supported by the second support assembly 234. According to various aspects, the second support assembly 234 may be a mirror image of the first support assembly 154. The second support assembly 234 may include a second cantilever support 282 that is coupled to a second adapter member 286.

The second adapter member 286 may include the coupling portion 246 configured to be inserted within the interior of the second cantilever support 282. The coupling portion 246 of the second adapter member 286 may be mechanically fastened to the second end 182 of the second cantilever support 282. Similar to the first adapter member 242, the rear edge 250 of the second adapter member 286 may have a height greater than the height of the front edge 254 of the second adapter member 286. The front edge 254 may have a height that corresponds to the second end 182 of the second cantilever support 282. The rear edge 250 of the second adapter member 286 may have a greater height to increase the surface area of the second adapter member 286 that engages with the second ladder rack 162.

According to various aspects, the second support assembly 234 may include a second locking member 290, which may include the first and second arms 206, 210 and the connector 214. The connector 214 of the second locking member 290 may be disposed within the notch 198 defined by the second adapter member 286. The first and second arms 206, 210 of the second locking member 290 may extend outward and away from the second cantilever support 282.

Additionally or alternatively, the second support assembly 234 may include a second rail assembly 294 disposed on the upper support wall 178 of the second cantilever support 282. The second rail assembly 294 may include the rail 226 coupled to the second cantilever support 282 and the rail slide 230 slidably engaged with the rail 226. In various examples, the first and second rail assemblies 262, 294 may simultaneously translate. In this way, the first and second rail assemblies 262, 294 for may simultaneously move first and second sides 298, 302 of the storage feature 90, which may provide easier movement between the stowed and deployed positions 94, 98 (FIG. 1).

Referring still to FIG. 4, the second support assembly 234 may include a second spacer 306. The second spacer 306 may include the protrusion 270 that extends therefrom. The protrusion 270 may engage the receiving aperture 274 defined by the second cantilever support 282. The receiving aperture 274 may be defined by the second side 174 of the second cantilever support 282. In this way, the second spacer 306 may be coupled to the outer surface 278 of the second cantilever support 282. Additionally or alternatively, the first and second spacers 266, 306 may be oriented outward, away from one another, such that the respective protrusions 270 extend toward one another when the first and second support assemblies 154, 234 are assembled.

In various examples, the first and second ladder racks 158, 162 may have substantially similar configurations to one another. Each of the first and second ladder racks 158, 162 may include the first sidewall 26 and the second sidewall 30. The first and second sidewalls 26, 30 may be spaced-apart from one another. The first and second sidewalls 26, 30 may be coupled to one another via the connecting wall 34. The connecting walls 34 of each of the first and second ladder racks 158, 162 may each define the plurality of apertures 38. In various examples, each connecting wall 34 may be configured as a plurality of connecting walls 34 spaced-apart by the respective plurality of apertures 38.

Figure 5:
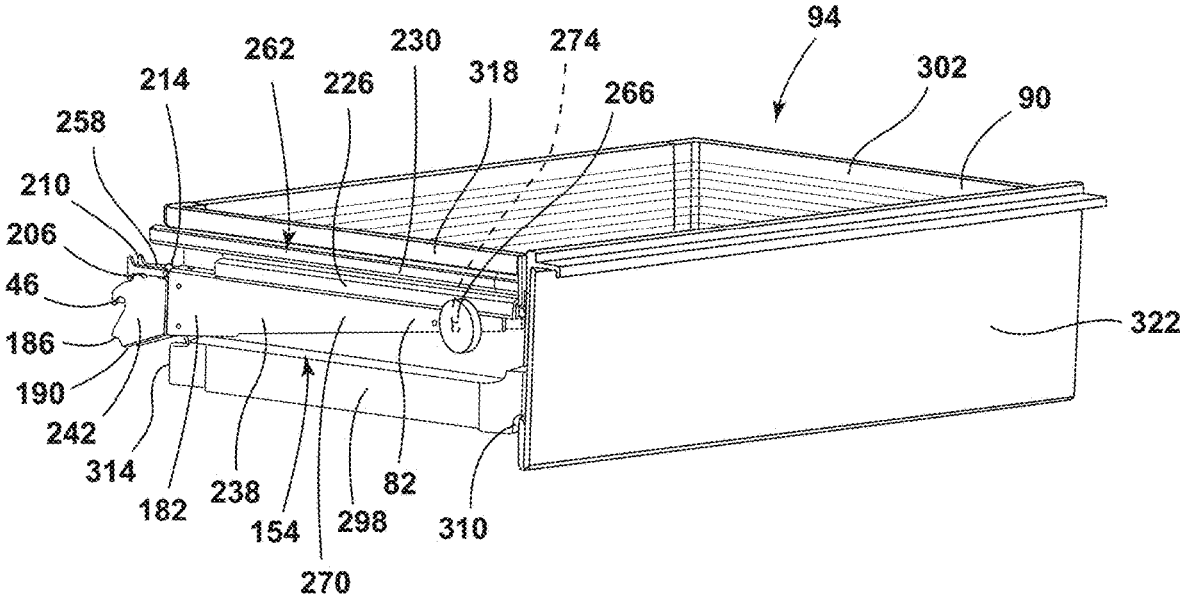
FIG. 5 is a side perspective view of an appliance storage feature with a support assembly, according to the present disclosure.

Referring to FIG. 5, as illustrated, the first support assembly 154 is assembled with the first side 298 of the storage feature 90. It is contemplated that the second support assembly 234 (FIG. 4) may be similarly configured, such that the second support assembly 234 is a mirror image of the first support assembly 154 and may be coupled to the second side 302 of the storage feature 90. The first cantilever support 238 may extend along the first side 298 of the storage feature 90. According to various aspects, the first cantilever support 238 may extend between first and second edges 310, 314 of the first side 298 of the storage feature 90 when the storage feature 90 is in the stowed position 94. In this way, the first cantilever support 238 may extend at least a portion of the depth of the storage feature 90. As illustrated in FIG. 5, the first cantilever support 238 extends from the first edge 310 to the second edge 314 and extends the entire depth of the storage feature 90 when in the stowed position 94. The first and second edges 310, 314 are illustrated as front and rear edges, however, it is contemplated that the first and second edges 310, 314 may be upper and lower edges, or lateral edges, of the storage feature 90. The first adapter member 242 may be coupled to the second end 182 of the first cantilever support 238 proximate the second edge 314 of the storage feature 90 when in the stowed position 94.

Additionally or alternatively, the first adapter member 242 may extend outward beyond the second edge 314 of the storage feature 90. When the storage feature 90 is in the stowed position 94 and the deployed position 98 (FIG. 1). The first locking member 258 may be coupled to the first adapter member 242 proximate the second edge 314 of the storage feature 90 when in the stowed position 94. The first and second arms 206, 210 of the first locking member 258 may extend outward beyond the second edge 314 of the storage feature 90. It may be advantageous for the first adapter member 242 and the first locking member 258 to extend beyond the second edge 314 (e.g., the rear edge) of the storage feature 90 to engage the first ladder rack 158 (FIG. 1) with minimal or no interference from the storage feature 90 when the storage feature 90 is in the stowed position 94.

According to various aspects, the receiving aperture 274 that is defined by the first cantilever support 238 may be disposed proximate the first end 82 of the first cantilever support 238 and the first edge 310 of the storage feature 90 when in the stowed position 94. The first spacer 266 may be coupled to the outer surface 278 of the first cantilever support 238 and the protrusion 270 may extend toward the first side 298 of the storage feature 90. The storage feature 90 may be coupled to the rail slide 230 of the first rail assembly 262. In various examples, a top edge 318 of the storage feature 90 may be coupled to the rail slide 230. It is contemplated that the second support assembly 234 may be similarly configured without departing from the teachings herein.

As illustrated in FIG. 5, the storage feature 90 is configured as a drawer. The drawer 90 may be operable between the stowed position 94 and the deployed position 98 (FIG. 1) via movement of the rail slide 230 with respect to the rail 226 coupled to the first cantilever support 238. In examples where the storage feature 90 is configured as a drawer, a front panel 322 of the storage feature may extend laterally outward beyond the first and second sides 298, 302 of the storage feature 90. In this way, the front panel 322 may at least partially obscure the view of the first and second support assemblies 154, 234 coupled to the first and second sides 298, 302 of the storage feature 90. This configuration may be advantageous for increasing the aesthetics of the appliance 10.

Other configurations of the storage feature 90 may be similarly arranged with the first and second support assemblies 154, 234. In such configurations, for example, where the storage feature is a shelf, a wine rack and/or a bin the first and second support assemblies 154, 234 may extend at least a portion of the depth of the storage feature 90 when in the stowed position 94. Further, in such examples, the storage feature 90 may be operable between the stowed and deployed positions 94, 98 by the first and second rail assemblies 262, 294. This may be advantageous for providing increased access to the storage feature 90. In configurations where the storage feature 90 may not include the front panel 322, the first and second support assemblies 154, 234 may be at least partially visible to a user.

Figure 6:
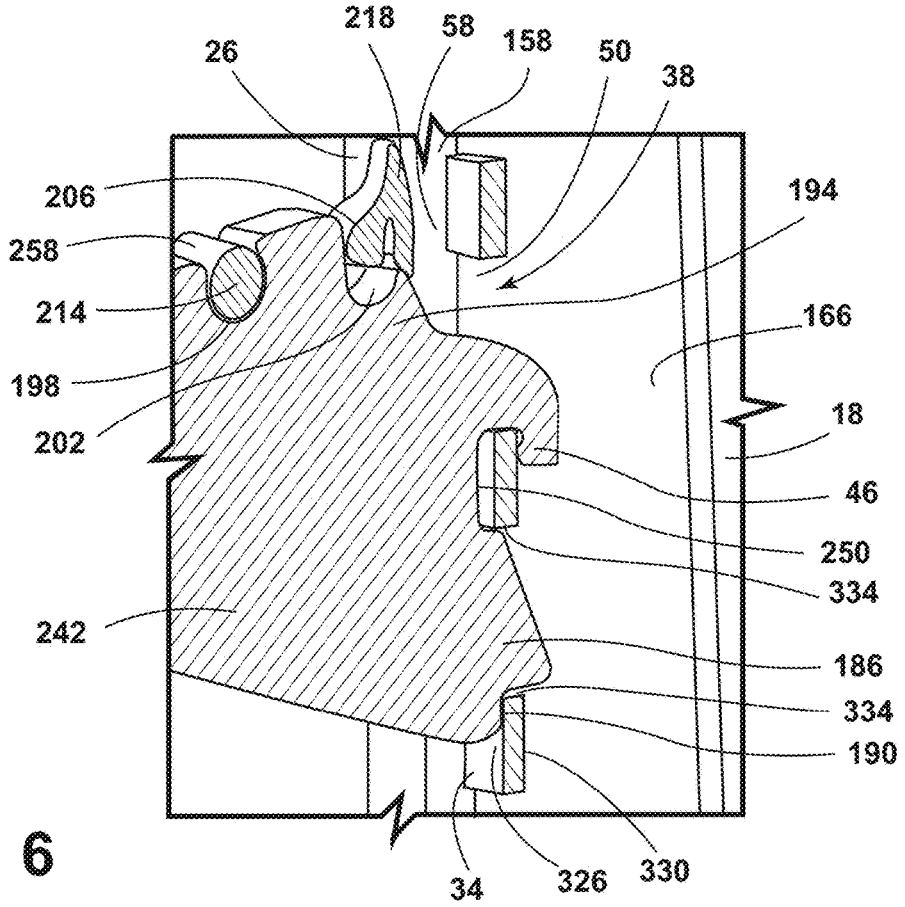
FIG. 6 is a partial cross-sectional view of an interface between an adapter member and a ladder rack of a support assembly for an appliance, according to the present disclosure.

Referring to FIG. 6, the first adapter member 242 may include the hook 46 and the projection 186 spaced-apart from one another. The hook 46 may extend from the rear edge 250 of the first adapter member 242 through one of the apertures 50 defined by the first ladder rack 158. The rear edge 250 of the first adapter member 242 may abut a first surface 326 of the connecting wall 34 of the first ladder rack 158. In this way, the rear edge 250 may be configured as the abutting surface 190. The hook 46 may extend through the aperture 50 and abut, and/or engage, a second surface 330 of the connecting wall 34. In various examples, the second surface 330 may be oriented toward the rear panel 166 of the inner liner 18.

The projection 186 may extend through one aperture 50 adjacent to the hook 46. Stated differently, the hook 46 extends through one aperture 50 and the projection 186 extends through another adjacent aperture 50. The projection 186 may extend through an aperture 50 that is disposed vertically below the aperture 50 the hook 46 extends through. In various examples, the projection 186 may have a height that corresponds to a height of the aperture 50 through which the projection 186 extends. In this way, the projection 186 may abut one or both inner edges 334 of the connecting wall 34 that define the aperture 50.

The engagement of the hook 46 and the projection 186 with the connecting wall 34 may couple the first adapter member 242 to the first ladder rack 158. Additionally or alternatively, the rear edge 250 may abut the connecting wall 34 which may provide additional stability to the first support assembly 154. According to various aspects, the first locking member 258 may be coupled to the first adapter member 242 and engage the first ladder rack 158. The connector 214 may be disposed in the notch 198 defined by the first adapter member 242. The first arm 206 may extend from the connector 214 toward the rear edge 250 of the first adapter member 242 in a substantially horizontal manner. In various examples, the first locking member 258 may engage the first ladder rack 158 in an interference fit. This may be advantageous to increase the stability of the second end 182 of the first cantilever support 238.

Additionally or alternatively, the first locking member 258 may engage the first and second sidewalls 26, 30 of the first ladder rack 158 to lockably engage the first adapter member 242 to the first ladder rack 158. As illustrated in FIG. 6, the first arm 206 includes the distal engagement portion 218. The distal engagement portion 218 may engage the inner surface 58 of the first sidewall 26 of the first ladder rack 158. It is contemplated that the distal engagement portion 222 of the second arm 210 may engage the inner surface 62 of the second sidewall 30 of the first ladder rack 158 in a similar manner. In this way, the first and second arms 206, 210 may engage the first and second sidewalls 26, 30 in an interference fit. In a non-limiting example, the first locking member 258 may exert an outward biasing force on the first and second sidewalls 26, 30 of the first ladder rack 158. The biasing force may provide additional stabilization to the first support assembly 154 when the first support assembly 154 is engaged with the first ladder rack 158. Moreover, the first and second arms 206, 210 may compress inward when engaged with the first ladder rack 158 to produce the interference fit or outward biasing force. The cutout 202 of the first adapter member 242 may provide additional space for the movement of the first and second arms 206, 210.

Referring to FIGS. 4 and 6, the second adapter member 286 may be configured to engage the second ladder rack 162 in a similar manner. In this way, the second adapter member 286 may include the hook 46 and the projection 186 that extends through adjacent apertures 50 that are defined by the connecting wall 34 of the second ladder rack 162. The second locking member 290 may engage the first and second sidewalls 26, 30 of the second ladder rack 162 in the interference fit. In this way, the first and second adapter members 242, 286 may couple the first and second support assemblies 154, 234 to the first and second ladder racks 158, 162. In addition to the first and second adapter members 242, 286, the first and second locking members 258, 290 may engage the first and second ladder racks 158, 162 to increase the stability of the second end 182 of each of the first and second cantilever supports 238, 282.

Figure 7:
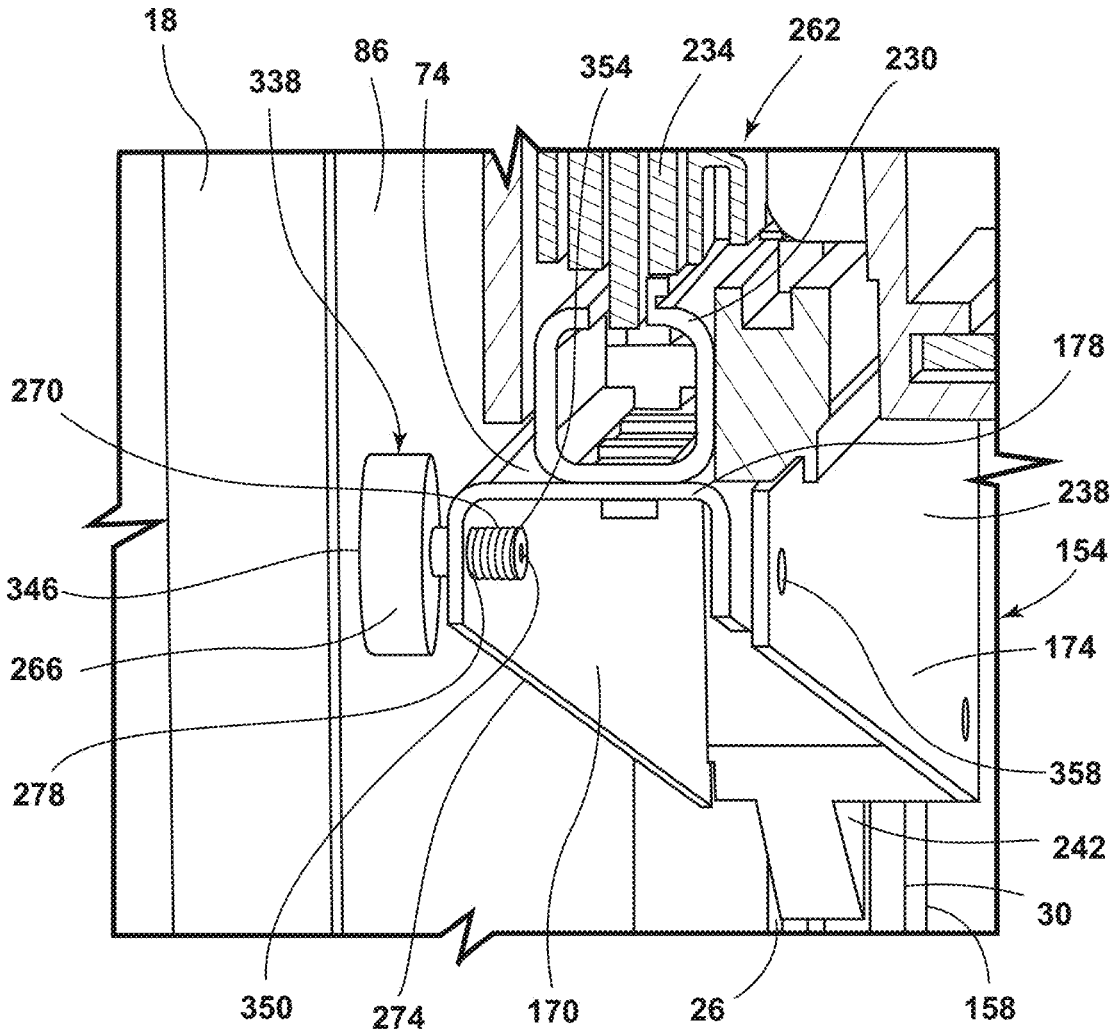
FIG. 7 is a front perspective view of a support assembly that engages an inner liner of an appliance, according to the present disclosure.

Referring to FIG. 7, the first spacer 266 may engage the first cantilever support 238. The first spacer 266 may include the protrusion 270, which may be configured as a threaded protrusion. In such examples, the receiving aperture 274 may include threads corresponding to the threaded protrusion 270. Stated differently, the first spacer 266 may include the threaded protrusion 270 that engages with the threaded receiving aperture 274 defined by the first cantilever support 238. In various examples, the first cantilever support 238 may be spaced-apart from the inner liner surface 86 of the inner liner 18. As illustrated in FIG. 7, the inner liner surface 86 is configured as a side surface of the inner liner 18.

The first spacer 266 may be disposed within a gap 338, defined between the inner liner surface 86 and the first cantilever support 238. A position of the first spacer 266 relative to the outer surface 278 of the first cantilever support 238 may be adjustable by rotation of the first spacer 266 in the receiving aperture 274. Adjustment of the first spacer 266 may correspondingly adjust the size of the gap 338 that is defined between the first cantilever support 238 and the inner liner surface 86. Stated differently, the gap 338 can be adjusted in response to adjustment of the position of the first spacer 266 relative to the outer surface 278 of the first cantilever support 238. In this way, the gap 338 may be adjusted via rotation of the first spacer 266. The gap 338 may be advantageous for improving airflow within the cabinet 102 of the appliance 10. Additionally or alternatively, the gap 338 may increase the uniformity of the cooling performance and air distribution within the appliance 10.

The first spacer 266 may abut the inner liner surface 86. This configuration may be advantageous for increasing stabilization of the first cantilever support 238, and accordingly, the first support assembly 154, when the storage feature 90 moves between the stowed and deployed positions 94, 98. In this way, the first spacer 266 may increase stability and/or provide support for the first support assembly 154 when the storage feature is in the stowed position 94, when the storage feature 90 is in the deployed position 98, and when the storage feature 90 translates therebetween. The first spacer 266 may include, for example, plastic materials and/or rubber materials. In plastic examples, the first spacer 266 may have an increased rigidity relative to the rubber examples. In this way, the first spacer 266 may limit and/or prevent lateral movement of the first support assembly 154. This configuration may be advantageous to reduce and/or prevent movement of the first support assembly 154 as the storage feature 90 translates along the first rail assembly 262. In a non-limiting example, the plastic first spacer 266 may be utilized in the first support assembly 154 when the storage feature 90 is configured as the wine rack. The wine rack configuration may have increased sensitivity to vibrations that can result from the addition and/or removal of bottles on the wine rack relative to other configurations of the storage feature 90. In rubber examples, the first spacer 266 may limit lateral movement of the first support assembly 154. The rubber first spacer 266 may allow slight movement of the first support assembly 154 while reducing vibrations. This configuration may also be advantageous for protecting the inner liner 18 from scratches and/or other similar damage. Additionally or alternatively, when the first spacer 266 includes rubber materials, the spacer may elastically deform in response to a force acting on the first spacer 266 to stabilize the first cantilever support 238.

Referring to FIGS. 1, 4 and 7, it is contemplated that the second spacer 306 may be configured similarly to the first spacer 266. The second spacer 306 may include the threaded protrusion 270 that engages the threaded receiving aperture 274 that is defined by the second cantilever support 282. The second spacer 306 may be disposed between an opposing inner liner surface 342 and the second cantilever support 282. In this way, the gap 338 may be defined between the opposing inner liner surface 342 and the second support assembly 234. It is contemplated that the first and second support assemblies 154, 234 may be substantially mirror images of one another and may operate in a similar manner.

The first and second cantilever supports 238, 282 may be tightened toward the respective inner liner surface 86, 342. In this way, the size of the respective gaps 338 may be altered. The first and second spacers 266, 306 may provide rigidity to the respective first and second support assemblies 154, 234. The first and second spacers 266, 306 can be screwed into the first and second cantilever supports 238, 282 through the rotatable engagement of the threaded protrusions 270 with the threaded apertures 274.

Referring to FIGS. 1-7, the first and second support assemblies 154, 234 may be coupled to the first and second ladder racks 158, 162. The first and second adapter members 242, 286 may engage the connecting walls 34 and extend through the plurality of apertures 38 defined by the first and second ladder racks 158, 162. The first and second cantilever supports 238, 282 may extend outwardly from the first and second ladder racks 158, 162. In this way, the first and second cantilever supports 238, 282 may extend from the rear panel 166 of the inner liner 18 toward the door 150 of the appliance 10. The first and second locking members 258, 290 may each engage the first and second ladder racks 158, 162 in the interference fit to increase the stability of the second end 182 of each of the first and second cantilever supports 238, 282. The first and second spacers 266, 306 may engage the outer surfaces 278 of the first and second cantilever supports 238, 282. In this way, the first and second spacers 266, 306 may provide stability to the first end 82 of each of the first and second cantilever supports 238, 282.

After the storage feature 90 is positioned on the first and second cantilever supports 238, 282 coupled to the first and second ladder racks 158, 162, the first and second spacers 266, 306 may be rotated to abut the inner liner surfaces 86, 342. In this way, a body 346 of the spacers 266, 306 may be spaced-apart from the first and second cantilever supports 238, 282 by the protrusions 270 to abut the respective inner liner surfaces 86, 342 to reduce lateral movement of the first and second cantilever supports 238, 282. The protrusions 270 of each of the first and second spacers 266, 306 may define at least one slot 350 in an end 354 thereof for engaging a tool, such as, for example, a screwdriver. The end 354 of each of the protrusions 270 that defines the slot 350 may be accessible by a user to adjust the first and second spacers 266, 306 with respect to the inner liner surfaces 82, 342. An access hole 358 may be defined in the first and second cantilever supports 238, 282 to align with the aperture 274. In the first cantilever support 238, the aperture 274 may be defined in the first wall 170 (e.g., an outer wall) and the access hole 358 may be defined in the second wall 174 (e.g., an inner wall). In the second cantilever support 282, the aperture 274 may be defined in the second wall 174 (e.g., the outer wall) and the access hole 358 may be defined in the first wall 170 (e.g., the inner wall). In this way, the access holes 358 can be accessed from a space defined between the first and second cantilever supports 238, 282. The tool can extend through the access holes 358 to engage the slot 350 and allow for rotation of the respective first and second spacers 266, 306. The access holes 358 may be coaxial with the apertures 274.

Accordingly, the first and second support assemblies 154, 234 may include stabilizing features disposed at both of the opposing first and second ends 82, 182 of the first and second cantilever supports 238, 282. It is also contemplated that a single spacer 78 may be used. In this way, the spacer 78 may be associated with one of the first and second support assemblies 154, 234. Additionally or alternatively, the hook 46 and the projection 186 of each of the first and second adapter members 242, 286 may extend through the apertures 50 of the plurality of apertures 38 to secure and/or retain the first and second support assemblies 154, 234 to the first and second ladder racks 158, 162.

Use of the present disclosure may provide a variety of advantages. For example, the first and second support assemblies 154, 234 may include the first and second rail assemblies 262, 294, which may translate the storage feature 90 between the stowed and deployed positions 94, 98. Additionally, the storage feature 90 may be operable between the stowed and deployed positions 94, 98 which can improve accessibility to the storage feature 90 for the user. Further, the first and second spacers 266, 306 may provide for adjustment of the gaps 338 between the respective inner liner surface 86, 342 and each of the first and second cantilever supports 238, 282. Additionally, the gaps 338 may increase airflow within the appliance 10. Moreover, the first and second locking members 258, 290 may provide increased stability to the second end 182 of each of the first and second cantilever supports 238, 282 through the interference fit with the first and second ladder racks 158, 162. Also, the first and second spacers 266, 306 may provide increased stability to the first end 82 of the first and second cantilever supports 238, 282. Further, the first and second spacers 266, 306 may reduce lateral movement of the first and second support assemblies 154, 234, and accordingly, the storage feature 90. The reduction in the lateral movement may occur when the storage feature 90 is in the stowed position 94, the deployed position 98, and when translating therebetween. Additional benefits or advantages of using this device may also be realized and/or achieved.

According to at least one aspect of the present disclosure, a vacuum insulated appliance includes an outer wrapper and an inner liner positioned within the outer wrapper. A ladder rack is coupled to the inner liner. The ladder rack includes first and second sidewalls coupled together by a connecting wall that defines a plurality of apertures. An adapter member includes a hook configured to extend through an aperture of the plurality of apertures when coupled to the ladder rack.

The adapter member is coupled with a locking member that engages inner surfaces of the first and second sidewalls of the ladder rack. A cantilever support is coupled to the adapter member and extends outward from the ladder rack. A rail assembly is coupled to an upper surface of the cantilever support. A spacer is coupled to an end of the cantilever support and abuts an inner liner surface. A storage feature is coupled to the rail assembly and is operable between stowed and deployed positions.

According to another aspect, a locking member includes a first arm that engages a first sidewall and a second arm that engages a second sidewall. The first and second arms are coupled together via a connector.

According to another aspect, an adapter member defines a notch and a connector of a locking member is disposed within the notch.

According to still another aspect, first and second arms of a locking member engages first and second sidewalls in an interference fit.

According to another aspect, a storage feature is at least one of a bin, a shelf, a drawer, and a wine rack.

According to yet another aspect, a spacer includes a threaded protrusion engaged with a threaded receiving aperture defined by a cantilever support. A position of the spacer relative to an outer surface of the cantilever support adjustable via rotation of the spacer in the threaded receiving aperture.

According to another aspect, a gap defined between a cantilever support and an inner liner surface is adjusted with adjustment of a position of the spacer relative to an outer surface of the cantilever support.

According to at least one aspect of the present disclosure, an appliance support assembly includes an inner liner and a ladder rack coupled to the inner liner of the ladder rack includes first and second sidewalls. A cantilever support is coupled to the ladder rack and extends outwardly therefrom. A rail assembly is disposed on an upper surface of the cantilever support. A spacer is coupled to an outer surface of the cantilever support and abuts an inner liner surface. A locking member is coupled to the cantilever support and engages the first and second sidewalls of the ladder rack. A storage feature is coupled to the rail assembly and is operable between stowed and deployed positions.

According to another aspect, an adapter member is coupled between a ladder rack and a cantilever support.

According to still another aspect, an adapter member includes a hook and a projection spaced-apart from one another and each extends through apertures defined by a ladder rack to secure the adapter member to the ladder rack.

According to another aspect, a locking member engages first and second sidewalls of a ladder rack to lockably engage an adapter member to the ladder rack.

According to yet another aspect, a locking member engages a ladder rack via an interference fit to stabilize an end of a cantilever support.

According to another aspect, a spacer includes a threaded protrusion engaged with a threaded receiving aperture defined by a cantilever support.

According to still another aspect, a gap defined between a cantilever support and an inner liner surface is adjusted via rotation of the spacer with respect to the cantilever support.

According to another aspect, a spacer is elastically deformable to stabilize a cantilever support when a storage feature moves between stowed and deployed positions.

According to at least one aspect of the present disclosure, a support assembly for an insulated appliance includes first and second ladder racks coupled to an inner liner of the insulated appliance and are spaced-apart from one another. First and second adapter members are coupled to the first and second ladder racks. First and second cantilever supports are coupled to the first and second ladder racks via the first and second adapter members. At least one locking member engages one of the first and second ladder racks and one of the first and second adapter members. First and second rail assemblies are disposed on the first and second cantilever supports. A storage feature is coupled to the first and second rail assemblies and is operable between stowed and deployed positions.

According to another aspect, at least one spacer is coupled to an outer surface of an end of at least one of first and second cantilever supports to stabilize the end when a storage feature moves between stowed and deployed positions.

According to still another aspect, at least one locking member includes first and second locking members. The first and second locking members engage first and second ladder rack in interference fits.

According to yet another aspect, first and second spacers are coupled to outer surfaces of first and second cantilever supports.

According to another aspect, each of first and second spacers includes a threaded protrusion that engages a threaded receiving aperture defined by a respective first and second cantilever support.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated appliance, comprising:

an outer wrapper;

an inner liner positioned within the outer wrapper;

a ladder rack coupled to the inner liner, wherein the ladder rack includes first and second sidewalls coupled together via a connecting wall that defines a plurality of apertures;

an adapter member including a hook configured to extend through an aperture of the plurality of apertures when coupled to the ladder rack;

a locking member that engages inner surfaces of the first and second sidewalls of the ladder rack, wherein the locking member has first and second arms that extend parallel to one another, and wherein each of the first and second arms includes a distal engagement portion that extends perpendicular to the first and second arms;

a cantilever support coupled to the adapter member and extending outward from the ladder rack;

a rail assembly coupled to an upper surface of the cantilever support;

a spacer coupled to an end of the cantilever support and abutting an inner liner surface; and a storage feature coupled to the rail assembly and operable between stowed and deployed positions.

2. The vacuum insulated appliance of claim 1, wherein the first arm engages the first sidewall and the second arm engages the second sidewall, wherein the first and second arms are coupled together via a connector.

3. The vacuum insulated appliance of claim 2, wherein the adapter member defines a notch in a top edge thereof adjacent to the cantilever support, and wherein the connector of the locking member is disposed within the notch.

4. The vacuum insulated appliance of claim 1, wherein the first and second arms of the locking member engage the first and second sidewalls in an interference fit.

5. The vacuum insulated appliance of claim 1, wherein the storage feature is at least one of a shelf, a bin, a drawer, and a wine rack.

6. The vacuum insulated appliance of claim 1, wherein the spacer includes a threaded protrusion engaged with a threaded receiving aperture defined by the cantilever support, and wherein a position of the spacer relative to an outer surface of the cantilever support is adjustable via rotation of the spacer in the threaded receiving aperture.

7. The vacuum insulated appliance of claim 6, wherein a gap defined between the cantilever support and the inner liner surface is adjusted with adjustment of the position of the spacer relative to the outer surface of the cantilever support.

8. An appliance support assembly, comprising:

an inner liner;

a ladder rack coupled to the inner liner and including first and second sidewalls;

a cantilever support coupled to the ladder rack and extending outwardly therefrom;

a rail assembly disposed on an upper surface of the cantilever support;

a spacer operably coupled to an outer surface of the cantilever support and abutting an inner liner surface, wherein the spacer extends at least partially into a hollow interior of the cantilever support, and wherein the spacer includes a body having a height greater than a height of a distal end of the cantilever support;

a locking member coupled to the cantilever support and engaging the first and second sidewalls of the ladder rack, wherein the locking member engages the ladder rack via an interference fit to stabilize a proximal end of the cantilever support, and wherein first and second arms of the locking member each include a distal engagement portion that extends perpendicular to the first and second arms, respectively; and a storage feature coupled to the rail assembly and operable between stowed and deployed positions.

9. The appliance support assembly of claim 8, further comprising:

an adapter member coupled between the ladder rack and the cantilever support.

10. The appliance support assembly of claim 9, wherein the adapter member includes a hook and a projection spaced-apart from one another and each extending through apertures defined by the ladder rack to secure the adapter member to the ladder rack.

11. The appliance support assembly of claim 9, wherein the locking member engages the first and second sidewalls of the ladder rack to lockably engage the adapter member to the ladder rack.

12. The appliance support assembly of claim 8, wherein the spacer includes a threaded protrusion engaged with a threaded receiving aperture defined by the cantilever support, and wherein the threaded protrusion extends at least partially into the hollow interior of the cantilever support and the body abuts the inner liner.

13. The appliance support assembly of claim 12, wherein a gap defined between the cantilever support and the inner liner surface is adjusted via rotation of the spacer with respect to the cantilever support.

14. The appliance support assembly of claim 8, wherein the spacer is elastically deformable to stabilize the cantilever support when the storage feature moves between the stowed and deployed positions.

15. A support assembly for an insulated appliance, comprising:

first and second ladder racks coupled to an inner liner of said insulated appliance, wherein the first ladder rack is spaced-apart from the second ladder rack;

first and second adapter members coupled to the first and second ladder racks;

first and second cantilever supports coupled to the first and second ladder racks via the first and second adapter members, wherein each of the first and second cantilever supports includes first and second sidewalls coupled via an upper support wall;

at least one locking member engaging one of the first and second ladder racks, wherein the at least one locking member includes an arm and a distal engagement portion that extends perpendicular to the arm;

at least one spacer extending into a hollow interior of at least one of the first and second cantilever supports;

first and second rail assemblies disposed on the upper support walls of the first and second cantilever supports; and a storage feature coupled to the first and second rail assemblies and operable between stowed and deployed positions.

16. The support assembly of claim 15, wherein the at least one spacer is coupled to an outer surface of a distal end of at least one of the first and second cantilever supports to stabilize the distal end when the storage feature moves between the stowed and deployed positions, wherein a protrusion of the at least one spacer extends at least partially into the hollow interior through a threaded aperture defined by the first sidewall, and wherein the second sidewall defines an access hole coaxial with the threaded aperture and configured to receive a tool to engage an end of the protrusion.

17. The support assembly of claim 15, wherein the at least one locking member includes first and second locking members, and wherein the first and second locking members engage the first and second ladder racks in interference fits.

18. The support assembly of claim 15, wherein the at least one spacer includes first and second spacers coupled to outer surfaces of the first and second cantilever supports, wherein each of the first and second cantilever supports has a distal end, and wherein a body of each of the first and second spacers has a height greater than a height of each distal end.

19. The support assembly of claim 18, wherein each of the first and second spacers includes a threaded protrusion that engages a threaded receiving aperture defined by the respective first and second cantilever supports.

* * * * *